US005488781A

United States Patent [19]

Van Der Horst

[11] Patent Number: 5,488,781

[45] Date of Patent: Feb. 6, 1996

[54] POSITIONING APPARATUS FOR PRINTING PLATES

[75] Inventor: Hans Van Der Horst, Rijnsaterswoude, Netherlands

[73] Assignee: AV Flexologic B.V., Alphen Aan De Rijn, Netherlands

[21] Appl. No.: 354,915

[22] Filed: Dec. 13, 1994

[51] Int. Cl.[6] ..... B41B 11/00

[52] U.S. Cl. ..... 33/617; 33/286; 33/618; 33/DIG. 21

[58] Field of Search ..... 33/617, 286, 533, 33/613, 614, 618, 645, DIG. 21

[56] References Cited

U.S. PATENT DOCUMENTS 4,033,259 7/1977 Schuhmann ..... 33/618
4,309,804 1/1982 Sarka ..... 33/614
4,520,389 5/1985 Hornschuh ..... 33/617
5,058,287 10/1991 Harley ..... 33/618

*Primary Examiner*—Christopher W. Fulton
*Attorney, Agent, or Firm*—Banner & Allegretti, Ltd.

[57] ABSTRACT

The invention relates to an apparatus for positioning flexible printing plates comprising at least two markings on a printing cylinder, a support device for the printing cylinder, a projection device for projecting reference marks on the printing cylinder at a location where the markings will have to come, a display device for displaying the markings and the reference markings, and a positioning table extending substantially horizontal for locating the printing plate to be positioned.

14 Claims, 3 Drawing Sheets

POSITIONING APPARATUS FOR PRINTING PLATES

BACKGROUND OF THE INVENTION

The invention relates to an apparatus for positioning flexible printing plates comprising at least two markings onto a printing cylinder, comprising: support means for the printing cylinder; projection means for projecting reference marks on the printing cylinder at a location where the markings will have to come; and display means for displaying the markings and the reference markings.

Such an apparatus is known from EP-A-0329228.

In this known apparatus the flexible printing plate has to be positioned manually on the printing cylinder. It is assumed, that the flexible printing plate to be positioned comprises two markings, and that by the apparatus reference markings are projected on the position, where, with a correct positioning of the printing plate, the markings provided on the printing plate will be located. The remaining part of the flexible printing plate will be suspended along the printing cylinder, which adversely effects the positioning processes, as the gravity will try to pull the printing plate downward. Further, the chance that the printing plate will be damaged by these actions is considerable.

The aim of the present invention is to provide such an apparatus, in which the disadvantages mentioned above are avoided.

BRIEF SUMMARY OF THE INVENTION

This aim is reached by positioning the positioning table ahead of the printing plate to be positioned.

As a consequence of these features damaging of the printing plate hanging down is avoided, while the positioning actions are eased because the printing plate hanging down will not exert any force.

According to a preferred embodiment the positioning table is movable parallel to its main surface.

This movability leads to an improvement of the positioning; by removing the positioning table the flexible printing plate will be taken with the movements of the table, so that an exact positioning can be reached because the greatest part of the flexible printing plate rests on the positioning table.

Subsequently, the present invention will be elucidated with the help of the accompanying drawings.

DETAILED DESCRIPTION OF THE INVENTION

Figure 1:
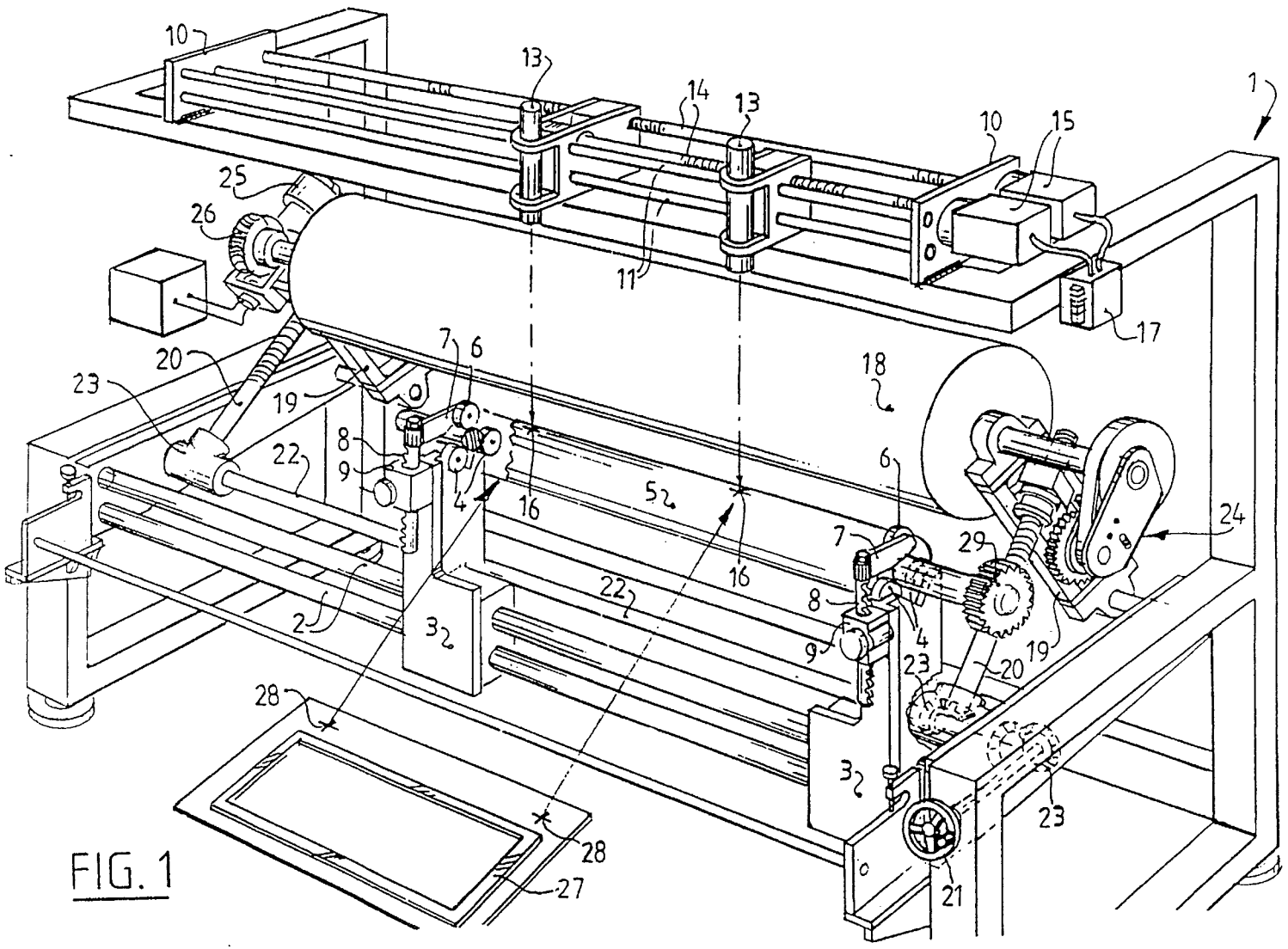
FIG. 1 is a schematic perspective view, partially broken away of a first embodiment of an apparatus according to the present invention.

The apparatus depicted in FIG. 1 comprises a frame 1 with two guiding shafts 2, onto which two movable supports 3 have been provided. Each of the supports 3 comprises two supporting wheels 4, onto which a pushing cylinder 5 can be located. The pushing cylinder 5 can be fixed onto the supporting wheels 4 by means of fixation wheels 6, which have been provided through a bracket 7, a rack 8 and a guiding element 9. The printing cylinder 5 located on the supporting wheels 4 can rotate freely.

At the upper side of the frame two plates 10 have been fixed, through which two guiding shafts 11 have been provided such that these are parallel to the shafts of the printing cylinder 5. Two yokes 12 are movable along these guiding shafts 11 and in each of the yokes 12 a light source 13 has been provided. Each of the light sources 13 is driven by means of a spindle shaft, which is driven by means of a motor 15. When switched on, both light sources emit a narrow ray of light downwards unto the printing cylinder 5. Thus, two for instance cross-shaped positioning markings 16 are projected on the printing cylinder 5.

Each of the motors 15 is connected with a control unit 17, which can dictate the position of both light sources 13 by means of the motors 15 and the spindle shafts 14.

A pressing roller 18 has been provided to the frame such by means of two yokes 19 that this pressing roller 18 can be located adjacent with the printing cylinder 5, in which account is taken of printing cylinders with different diameters by the movability of the pressing roller 18. The position of the pressing roller 18 is adjustable by means of two spindle shafts 20 which are actuabel simultaneously. Both spindle shafts 20 are driven by means of a hand wheel 21, a driving shaft 22 and several conical gear transmissions 23. At the outer side of one of the yokes 19 a coupling apparatus 24 has been provided, with which, when the pressing roller 18 is adjacent to the printing roller 5, both rollers are connected for rotation. Further, the pressing roller 18 comprises a driving motor 25, which drives the pressing roller 18 through a worm-wheel transmission 26.

Subsequently, the action of the apparatus described above will be elucidated. Initially, the position of the marks 28 located on the printing plate 27 are fed into the memory of the control unit 17. It is, of course, also possible that only the number of the printing plate 27 has to be entered and that the memory of the control unit 17, in which the number of the relevant printing plates and the co-ordinates of the marks belonging thereto have been stored. Subsequently, the control unit 17 will make the motors 15 drive the light sources such that the light sources 13 both take such a position that the required positioning markings 16 are projected on the relevant printing cylinder 5 on the required position.

Subsequently, the printing plate 27 can be positioned such on the printing cylinder 5 that the markings projected coincide with the marks 28.

When this stage is reached, the pressing roller 18 is driven by means of the motor 25, through which, through the coupling apparatus 24, the printing cylinder 5 is driven and the printing plate 27 is provided in the right position on the printing cylinder 5. Of course, it is possible that the back layer of the printing plate 27 or the circumference of the printing cylinder 5 has been provided with a suitable means of fixation.

Figure 2:
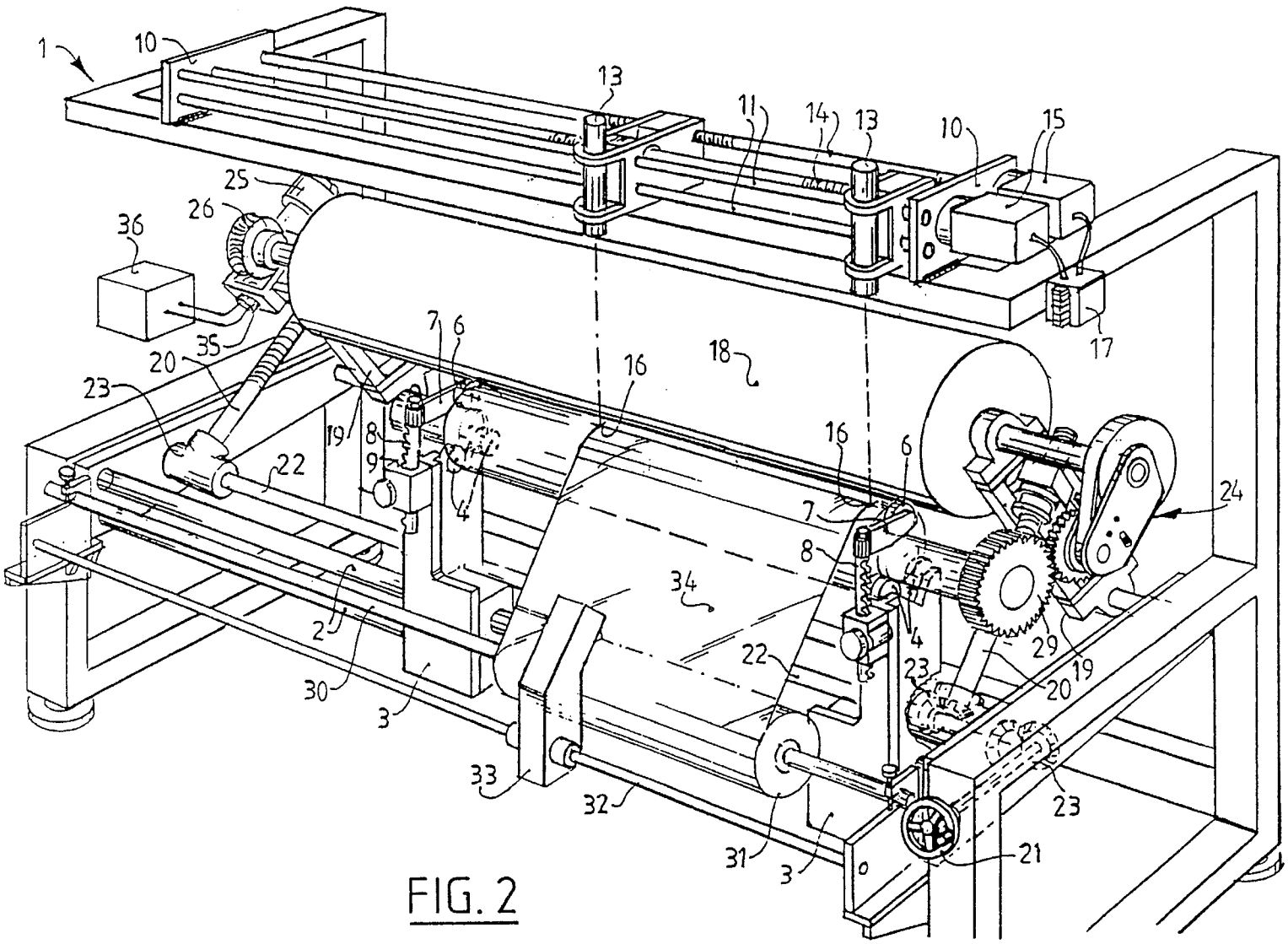
FIG. 2 is a schematic perspective view, partially broken away of the embodiment depicted in FIG. 1, wherein means have been provided for the application of double sided adhesive tape on the printing cylinder.

In the embodiment shown in FIG. 2, the printing cylinder 5 has been provided, of which the diameter is considerably larger than that of the printing cylinder 5 depicted in FIG. 1. Further, it is shown that the pressing roller 18 is moved until it is adjacent the printing cylinder 5.

Further, this embodiment comprises a shaft, extending parallel to the axis of the printing cylinder 5, onto which a coil 31 of double sided adhesive foil has been provided. At the upper side, this foil comprises a layer of protective paper.

On a shaft 32, also being provided parallel to the axis of the printing cylinder 5, a cutting organ 33 has been provided, which is movable along this shaft, and which can cut the length 34 of double sided adhesive foil leading from the coil 31 towards the printing cylinder 5.

In the worm wheel transmission 26 an angle rotation sensor 35 has been provided, which is connected with the signal generator 36. The angle rotation sensor 35 serves to divide the circumference of the printing cylinder 5, which is of importance to determine the initial position of the printing plate 27 departing from an initial or zero-position of the printing cylinder. Further, this is necessary when the printing plate 27 does not extend over the whole circumference and when several printing plates 27 have to be provided on the circumference.

To provide a layer of double sided adhesive foil on the printing cylinder 5 with this embodiment, one handles as follows: initially the diameter of the printing cylinder 5 is fed into the signal generator 36. Of course, it is possible that, when entering the number of the required printing plate into the control unit 17, the diameter belonging thereto is directly fed to the signal generator 36.

Subsequently, two positioning markings are being projected on the printing cylinder 5 by means of the laser light sources 13. Afterwards, so much foil is unwound from the coil 31, that the free end of the length 34 coincides with the projected positioning markings 16. Then the pressing roller 18 is driven by means of the motor 25, in which also the pressing roller is driven through the coupling apparatus 24 and the gear 29 provided at the pressing roller, so that the foil is fixed on the printing cylinder 5. This is continued until the signal generator 36 generates a signal stopping the motor 25.

The stroke 34 of foil is cut through by means of the cutting organ 33, after which the pressing process is continued by means of the motor 25, until the stroke 34 cut off is completely located on the printing roller.

The dimensioning of the cutting organ 33 and of the required angle of rotation of the printing cylinder 5 and thus of the pressing roller 18, which are sensed by the angle rotation sensor 35, is such that, the length of the stroke 34 of foil cut off suits exactly the circumference of the printing cylinder 5. This avoids that a part of the printing cylinder is covered with a double layer of foil, or that a slit develops in the layer of foil. Subsequently, the layer of covering paper can be removed from the foil, and the printing plate can be fixed by means of the method described with the help of FIG. 1.

It is also possible to provide video cameras and to pick up the projected laser marks and to display these through a displaying apparatus of a large size. This allows small relocations of the printing plate to be displayed on an enlarged scale, so that the positioning process can take place more accurately.

Figure 3:
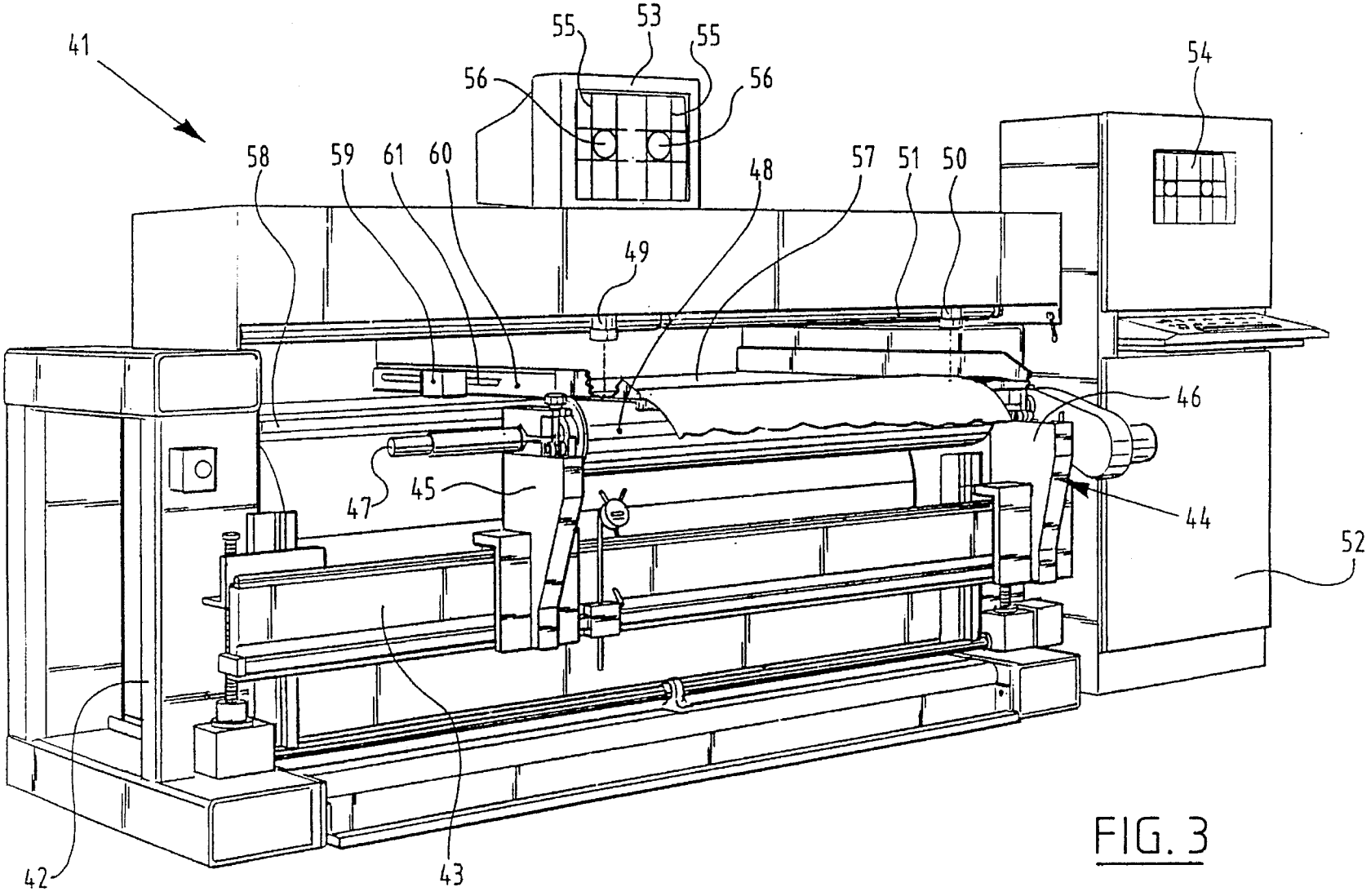
FIG. 3 a perspective view, partially broken away of a third embodiment of a positioning apparatus according to the present invention.

In FIG. 3 a positioning apparatus 41 has been depicted, which comprises a frame 42, on which a guiding rail 43 has been provided. A sub-frame 44 is movable along the rail 43. The sub-frame comprises two trestles 45, 46 between which a shaft 47 is journaled. On the shaft 47 a printing cylinder 48 has been provided, onto which a flexible printing plate has to be applied. For positioning the printing plate use is made of two video cameras 49, 50 which are attached removably along a rail 51 to the frame 42. For moving those cameras use is made of electric motors which are controlled through a computer 52 provided besides the positioning apparatus.

On the frame a video monitor 53 has been provided, whereas a second video monitor 54 is applied above the computer 52, so that the user of the computer can observe the positioning process. The view taken up by each video camera is together displayed on both of the video monitors 53, 54. The video cameras do not only display the displayed picture, but also the reference markings, that is a representation of the position on which the markings should be with a correct positioning of the printing plates. In the present embodiment these are displayed by double crosses, whereas the markings per se are represented by circles 56. This means that at least on the video monitors 53, 54 the markings 56 are surrounded by reference markings in the shape of double crosses 55, so that the positioning process becomes clearly visible, and the positioning is eased.

Further, this embodiment comprises a positioning table 57 which is movably attached to a carrier 58, which is a part of the frame 42.

The positioning table 57 extends tangentially relative to the printing cylinder 48, and indeed substantially in the horizontal direction.

The positioning table 57 is movable relative to the carrier 58 in the horizontal plane by means of a drive box 59 which is removably attached to the standing side 60 of the positioning table 57. An electric motor has been provided together with a gear, which gear is engaging a rack 61 provided at the standing side 60. By means of the drive box 59 this box is moved relative to the rack 61, and hence relative to the positioning table 57. At the other side of the positioning table 57 an upstanding rim 62 has been provided at the outer side whereof a corresponding drive apparatus has been provided.

By means of the two driving boxes it is possible to drive the positioning table in the direction perpendicular to the shaft of the printing cylinder 57, during the simultaneously driving of both drive boxes. Rotation of the positioning table 57 is possible by using only one of the drive boxes 59. Driving in the direction parallel to the shaft of the printing cylinder 48 takes place by means of a linear drive apparatus not depicted in the drawing, but which has been built in into the carrier 58.

It will be clear, that it is possible to use other drive apparatuses for the positioning table 57.

The drive apparatus described so far is controlled from the computer 52, which is programmed therefor. It is of course visible to process the picture displayed by the monitors 53, 54 by electronic means, for instance by means of pattern recognition programs, and to control the positioning table with the help thereof, so that the positioning takes place fully automatic.

It will be clear, that numerous amendments can be made to the apparatus described so far, without departing from the invention.

I claim:

1. Apparatus for positioning flexible printing plates comprising at least two markings on a printing cylinder, the apparatus comprising:

support means for the printing cylinder;

projection means for projecting reference marks on the printing cylinder at a location where the markings will have to come; and display means for displaying the markings and the reference markings, characterized by a positioning table extending substantially horizontal for locating the printing plate to be positioned.

2. Apparatus according to claim 1, characterized in that the positioning table extends substantially tangentially relative to the printing cylinder.

3. Apparatus according to claim 2, characterized in that the positioning table is movable parallel to its main surface.

4. Apparatus according to claim 3, characterized in that the positioning table is movable in the direction parallel to and perpendicular relative to the axis of the printing cylinder.

5. Apparatus according to claim 2, characterized in that the positioning table is rotatable around an axis, extending perpendicular to the surface of the table.

6. Apparatus according to one of the preceding claims, characterized in that the display means comprise at least a video camera and a video monitor.

7. Apparatus according to claim 6, characterized in that the video monitor has been arranged for displaying the picture picked up by more than one video camera.

8. Apparatus according to claim 6, characterized in that the video monitor has been arranged for displaying reference markings on the video monitor.

9. Apparatus according to claim 6, characterized in that the reference markings surround the markings with a correct positioning of the printing plate.

10. Apparatus according to claim 9, characterized in that the reference markings comprise double fitting crosses.

11. Apparatus according to claim 3, characterized in that the positioning table is rotatable around an axis, extending perpendicular to the surface of the table.

12. Apparatus according to claim 7, characterized in that the video monitor has been arranged for displaying reference markings on the video monitor.

13. Apparatus according to claim 7, characterized in that the reference markings surround the markings with a correct positioning of the printing plate.

14. Apparatus according to claim 8, characterized in that the reference markings surround the markings with a correct positioning of the printing plate.

* * * * *